United States Patent [19]

Kruck et al.

[11] Patent Number: 4,893,478

[45] Date of Patent: Jan. 16, 1990

[54] MODULAR REFRIGERATION APPLIANCE WHICH CAN BE ASSEMBLED AT A REMOTE LOCATION

[75] Inventors: Richard W. Kruck, Sodus Township, Berrien County; Ronald F. Iannelli, St. Joseph Township, Berrien County; Kevin S. Laundroche, Detroit, all of Mich.

[73] Assignee: Whirlpool Corporation, Benton Harbor, Mich.

[21] Appl. No.: 217,963

[22] Filed: Jul. 12, 1988

[51] Int. Cl.[4] ..... F25B 49/00

[52] U.S. Cl. ..... 62/126; 62/127; 62/298; 62/326; 62/449; 312/236

[58] Field of Search ..... 62/298, 326, 448, 449, 62/126, 127; 312/214, 236 X, 263

[56] References Cited

U.S. PATENT DOCUMENTS

| | | | |
|---|---|---|---|
| 2,502,581 | 4/1950 | Morrison . | |
| 2,509,779 | 5/1950 | Morrison . | |
| 2,521,064 | 9/1950 | Kleist . | |
| 2,605,617 | 8/1952 | Replogle . | |
| 2,826,044 | 3/1958 | Reer | 62/127 X |
| 3,220,206 | 11/1965 | Armentrout et al. | 62/127 |
| 3,674,328 | 7/1972 | White et al. | 312/263 |
| 3,995,922 | 12/1976 | Ohashi | 312/257 R |
| 3,999,820 | 12/1976 | Haag | 312/214 |
| 4,043,624 | 8/1977 | Lindenschmidt | 312/214 |
| 4,050,145 | 9/1977 | Benford | 29/460 |
| 4,308,724 | 1/1982 | LaGinestra | 62/126 |
| 4,404,813 | 9/1983 | Paddock et al. | 62/127 |
| 4,723,418 | 2/1988 | Whitmer | 62/298 |
| 4,726,193 | 2/1988 | Burke | 62/449 |
| 4,751,032 | 6/1988 | Salamon et al. | 264/46.5 |

*Primary Examiner*—Lloyd L. King

*Attorney, Agent, or Firm*—Mason, Kolehmainen, Rathburn & Wyss

[57] ABSTRACT

A refrigeration appliance includes a plurality of side panels and a base panel, one of the side panels containing within the inner and outer walls thereof a complete mechanical refrigeration unit. The side panels and the base panel are provided with integral interlocking means in the edges thereof so that the panels may be manufactured at one location and shipped in knock-down form to another location where the side panels may be readily assembled on the base panel by unskilled personnel without the use of tools or separate fastening means by simple engagement of the interlocking means in the panel edges. A lid or closure panel may then be secured to one of the side panels to provide a completely enclosed refrigerated compartment.

15 Claims, 11 Drawing Sheets

4
4
90
198
202
236
60
252
279
226
222
50
224
116
52
108
116
106
281
114
116
110
116
192
116
80
78
98a
275
277
56
156
138
136
279
132
136
132
136
134
130
134
130
134
130
134
98a
279
256
258
260
262
254
256
258
260
262
264
266
256
258
260
262

FIG. 10
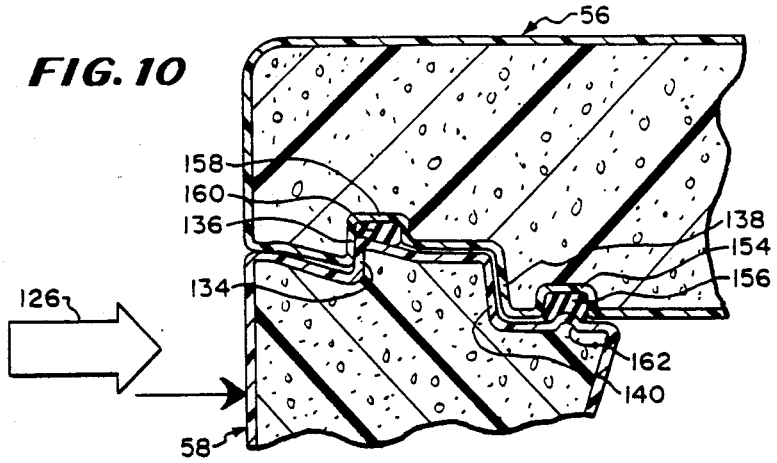
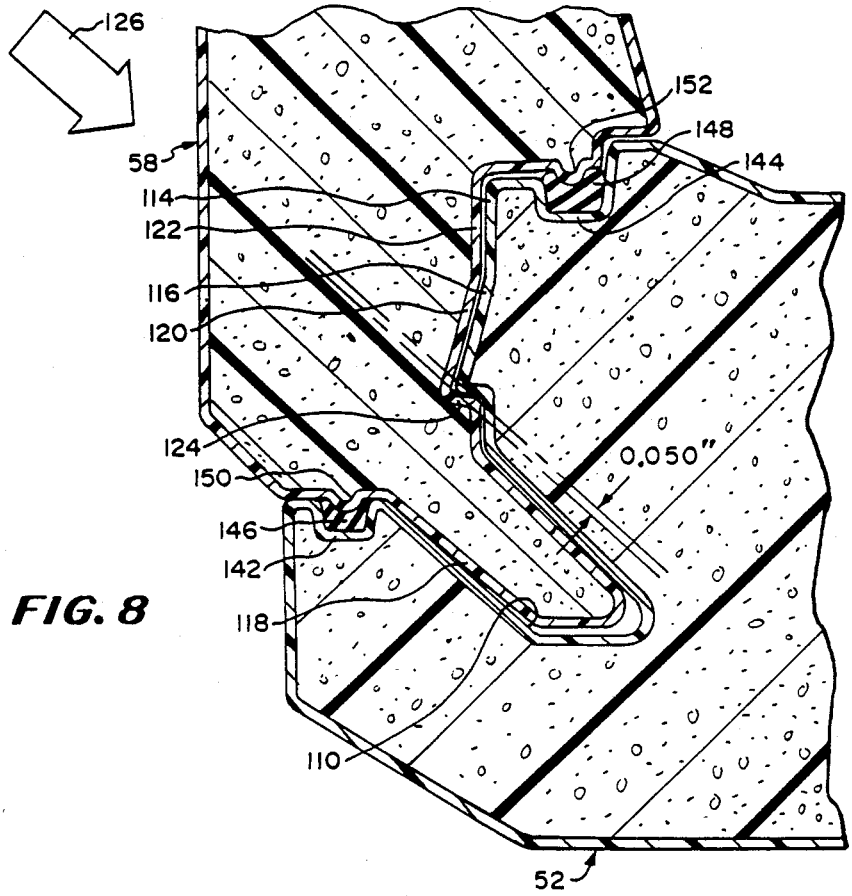
FIG. 8

MODULAR REFRIGERATION APPLIANCE WHICH CAN BE ASSEMBLED AT A REMOTE LOCATION

BACKGROUND OF THE INVENTION

A. Field of the Invention

The present invention generally relates to refrigeration systems, and, more particularly, to refrigeration systems of the demountable or so-called knockdown type which can be shipped disassembled to a desired location and then assembled into a refrigeration apparatus.

B. Description of the Prior Art

A number of arrangements have been heretofore proposed, both in the refrigeration art and elsewhere, wherein a demountable or knockdown construction is employed so that the apparatus may be shipped disassembled to a desired location and then assembled into a desired finished product. Arrangements of this type in the refrigeration art are exemplified by U.S. Pat. Nos. 2,127,111; 2,502,581; 2,507,379; 2,509,779; 2,521,064; 2,535,682; 3,392,497; 3,995,922; 4,358,213 and 4,632,470.

All of the above-enumerated arrangements are quite complicated in construction and are not particularly suitable for use in the domestic appliance field when assembly by the ultimate customer is contemplated. Furthermore, these refrigeration arrangements all require the use of tools and/or separate fastening means which adds to the complexity of such arrangements and renders them more difficult to assemble by an unskilled domestic appliance customer. In addition, none of the prior art arrangements, to applicants' knowledge, contemplates a demountable or knockdown refrigeration appliance in which a complete mechanical refrigeration unit is contained in one panel of the knockdown apparatus which panel can be readily assembled with other insulated panels to form a complete refrigeration appliance.

A number of arrangements have also been proposed in the refrigeration art wherein the mechanical refrigeration unit of a conventional refrigerator or freezer, or portions thereof, may be removed from the refrigeration cabinet for service or replacement, as exemplified in U.S. Pat. Nos. 2,445,988; 2,462,115; 2,509,614; 2,671,603; 2,936,598; 2,943,455; 3,131,551; 3,220,733; 3,433,031; 3,708,997; 3,850,006; 3,712,078; 3,871,188; 4,019,339; 4,354,359; 4,457,140; 4,490,990 and 4,509,335.

The removable mechanical refrigeration units in the arrangements enumerated above have generally been quite bulky and cumbersome to move and are unsuitable for incorporation into a demountable or knockdown refrigeration appliance, particularly one in which the mechanical refrigeration unit forms a relatively thin wall panel of such a refrigeration appliance.

A demountable or knockdown construction has also been proposed in a number of arrangements outside the refrigeration field. However, these arrangements, of course, have not contemplated incorporating a complete mechanical refrigeration unit in one wall of the knockdown structure or apparatus. Examples of demountable or knockdown construction outside the refrigeration art are shown in U.S. Pat. Nos. 305,286; 409,893; 419,920; 582,005; 1,534,468; 2,496,184; 3,565,503; 3,674,328; 3,722,157; 4,019,298; 4,127,353 and 4,408,812.

SUMMARY OF THE INVENTION

An object of the present invention is to provide a new and improved refrigeration appliance of modular construction wherein a complete mechanical refrigeration unit is contained within one wall panel which can be readily assembled with other insulated panels by inexperienced personnel to form a complete refrigeration appliance.

Another object of the present invention is to provide a new and improved demountable or knockdown refrigeration appliance which includes a plurality of side panels and a base panel, one of the side panels containing within the inner and outer walls thereof a complete refrigeration unit, the side panels and the base panel having integral cooperating means for interconnecting the same.

Another object of the present invention is to provide a new and improved demountable or knockdown refrigeration appliance wherein one side panel contains a sealed mechanical refrigeration system including an evaporator, a condenser, and a compressor interconnected in a sealed refrigerant system.

A further object of the present invention is to provide a new and improved refrigeration appliance wherein the same one side panel also contains motor driven fans for moving air over the evaporator and condenser.

Another object of the present invention is to provide a new and improved refrigeration appliance wherein the one side panel also contains a motor for driving the compressor.

Another object of the present invention is to provide a new and improved refrigeration appliance having a refrigerated compartment which is cooled by a mechanical refrigeration unit and means operable when the compartment is closed for developing a signal during periods when electrical power is supplied to the unit, the signal being visible from the exterior of the appliance.

Briefly, the present invention provides a new and improved refrigeration appliance of modular construction which includes a plurality of side panels and a base panel, one of the side panels containing within the inner and outer walls thereof a complete mechanical refrigeration unit. The side panels and the base panel are provided with integral interlocking means in the edges thereof so that the panels may be manufactured at one location and shipped in knockdown form to another location. The side panels may then be readily assembled on the base panel by unskilled personnel without the use of tools or separate fastening means by simple engagement of the interlocking means in the panel edges. A lid or closure panel may then be secured to one of the side panels to provide a completely enclosed refrigerated compartment.

The one side panel is relatively thin and lightweight and yet contains all of the electrical, mechanical, and control components of the refrigeration appliance so that no hook-ups or connections of any kind are required in assembling the appliance. More particularly, the one side panel contains a mechanical refrigeration system which includes an evaporator, a condenser, and a compressor interconnected in a sealed refrigerant system. The one side panel also contains motor driven fans for moving air over the evaporator and condenser so that air cooled by the evaporator is supplied to the interior of the refrigerated compartment and air heated by the condenser is forced out of the one side panel to the exterior. The one side panel also contains a motor for driving the compressor, thermostatic controls for the fan and compressor motors, an access light and a switch which is actuated by opening of the lid, thereby to illuminate the interior of the refrigerated compartment. A power cord extends from the outside wall of the one side panel. Assembly of the refrigeration appliance of the present invention, which may be accomplished by unskilled personnel, including the ultimate customer, thus requires only the mounting of the side panels on the base panel by engagement of the interlocking surfaces, mounting the closure panel on one of the side panels and plugging in the power cord.

In accordance with a further feature of the invention, the lid or closure panel of the refrigeration appliance can be locked to the front wall of the appliance to prevent opening thereof, without requiring the installation of any components or fastening means at the time of assembly. More particularly, the closure panel, as shipped, includes an arm rotatably mounted in one edge thereof, the arm being positioned to engage a shoulder formed in the upper edge of the front wall when the arm is rotated while the lid is down. The arm may be rotated by inserting a key in a lock mounted in the lid, after which the key may be removed to prevent entry when the refrigeration appliance is, for example, a chest freezer.

In accordance with a further feature of the invention, a light source is mounted in the edge of the one side panel which faces the front panel, the light source being positioned in alignment with an opening in the front panel of the appliance when the side panels are assembled on the base panel. The light source is energized during periods when power is applied to the mechanical refrigeration unit, thereby to provide through the opening a visual indication that the appliance is turned on.

BRIEF DESCRIPTION OF THE DRAWING

The above and other objects, advantages and novel features of the present invention will become apparent from the following detailed description of a preferred embodiment of the invention illustrated in the accompanying drawing, wherein:

FIG. 8 is a sectional view taken along the line 8—8 of FIG. 1 and shown on an enlarged scale;

FIG. 10 is a sectional view taken along the line 10—10 of FIG. 1;

DESCRIPTION OF THE PREFERRED EMBODIMENT

1. General Description

Figure 1:
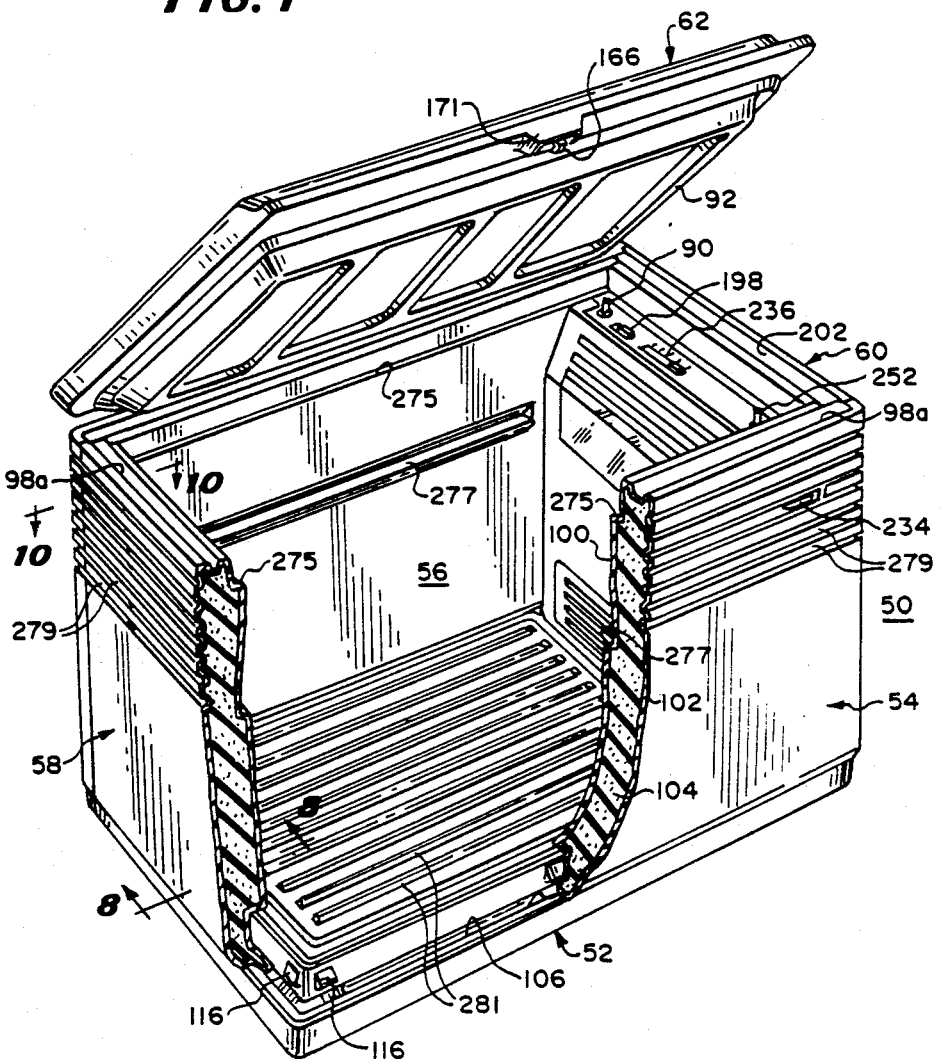
FIG. 1 is a frontal perspective view of a knockdown chest freezer embodying features of the present invention and shown with portions of the front and left-hand side panels broken away.
Figure 2:
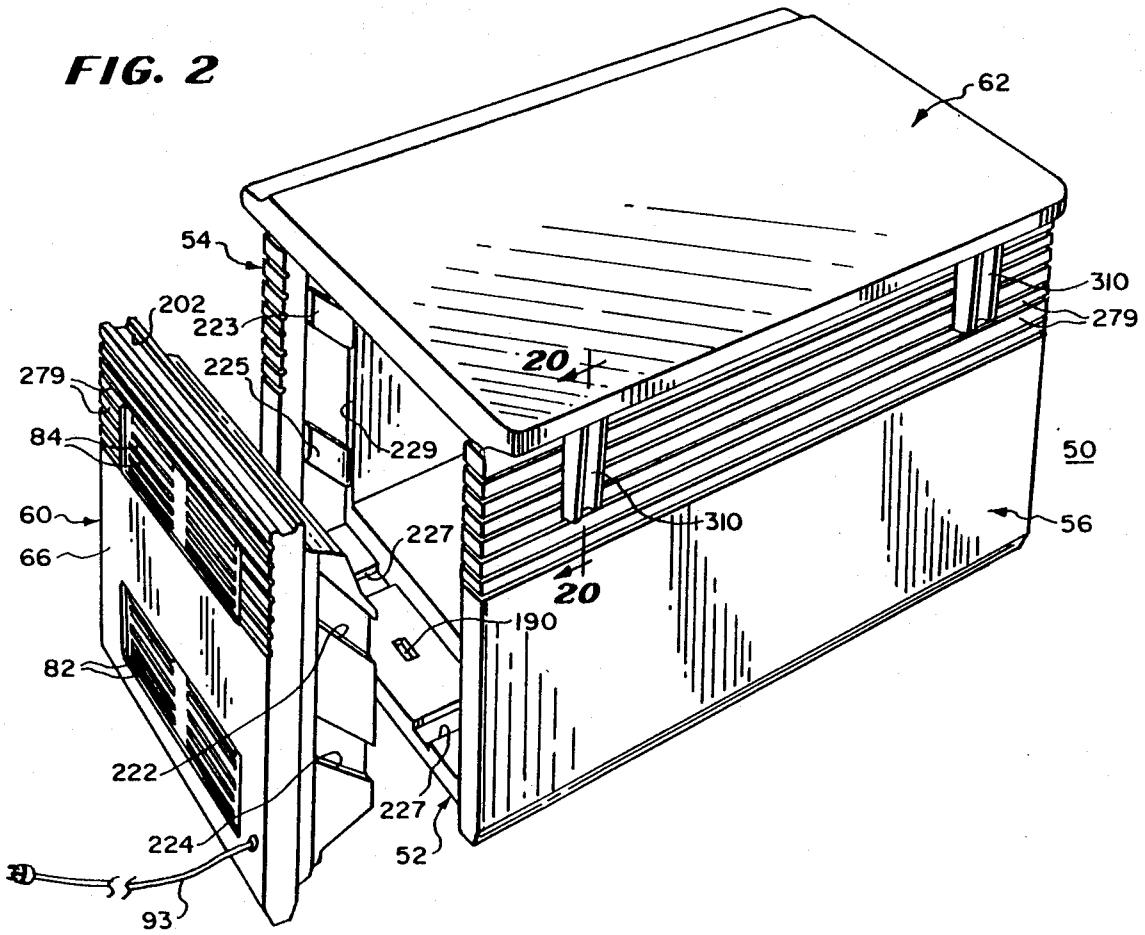
FIG. 2 is a rear perspective view of the chest freezer of FIG. 1 shown with the lid closed and with the right-hand side panel, which contains a complete mechanical refrigeration unit, disassociated from the remainder of the freezer.
Figures 3, 3A, 3B:
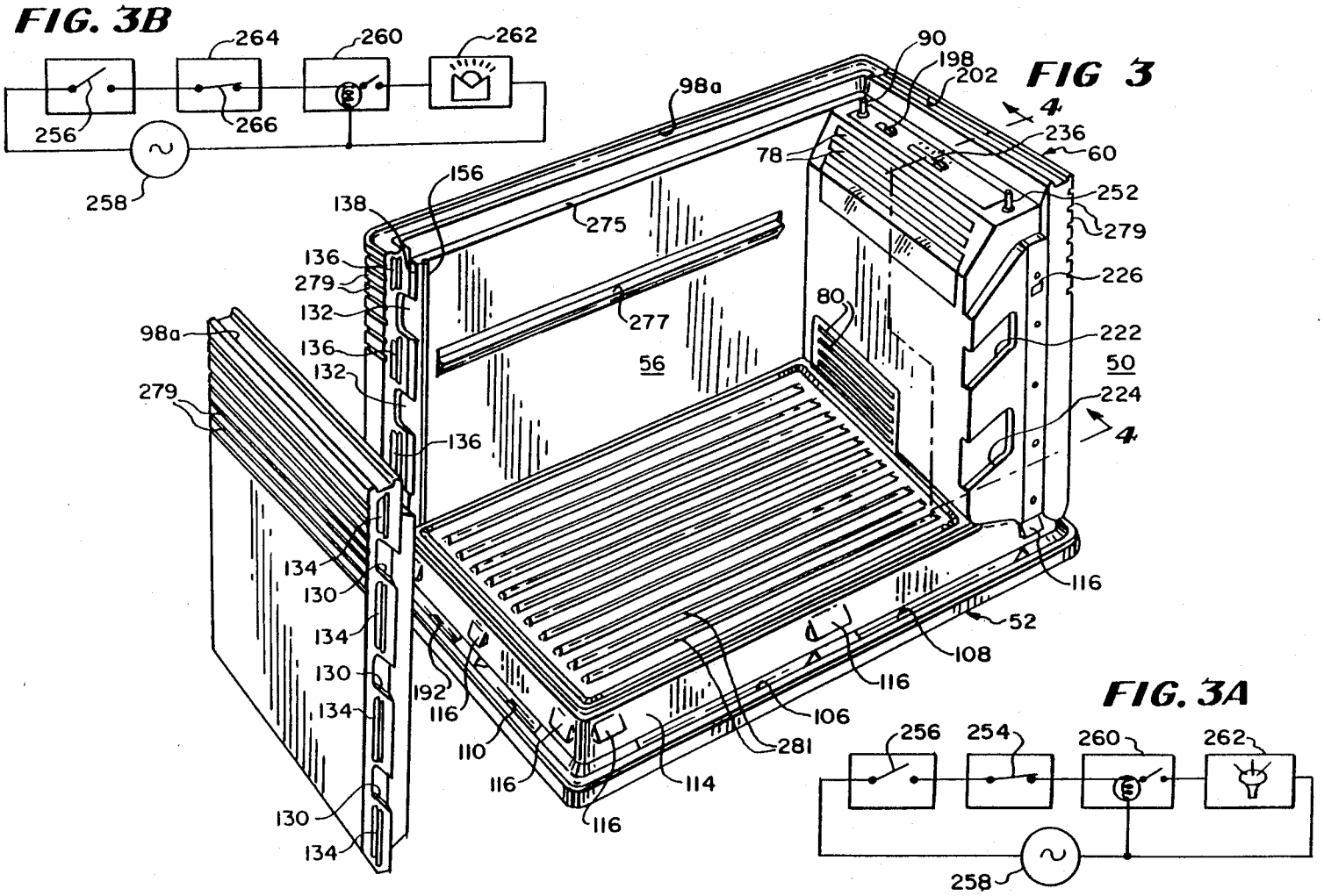
FIG. 3 is a frontal perspective view of the freezer, similar to FIG. 1 but shown without the front panel and lid, and with the left-hand side panel removed from the base and rear panels.
FIG. 3A is a circuit diagram of a lid closure detecting arrangement employed in the freezer of FIG. 1.
FIG. 3B is a circuit diagram of an alternative lid closure detecting arrangement which employs a vacuum controlled switch.

Referring now to the drawing and initially to FIGS. 1, 2 and 3 thereof, the features of the present invention are disclosed in a chest freezer indicated generally at 50. In accordance with an important aspect of the disclosed arrangement, the freezer 50 is of demountable or knockdown construction so that the individual modules or panels thereof may be shipped disassembled to a desired location and then assembled into a finished freezer by unskilled personnel, including the ultimate customer, without the use of special tools or separate retaining means. More particularly, the freezer 50 includes a base panel indicated generally at 52, a front panel indicated generally at 54, a rear panel indicated generally at 56, a left-hand end panel indicated generally at 58 and a right-hand end panel indicated generally at 60. The base panel 52 and the side panels 54–60 are provided with integral interlocking surfaces in the edges thereof, which will be described in more detail hereinafter, so that the side panels 54–60 may be readily assembled on the base panel 52 by simple engagement of these interlocking surfaces in the panel edges. More particularly, the front and rear panels 54 and 56 are first mounted on the base panel 52 and the side panels 58 and 60 are then interfitted with the ends of the front and rear panels 54, 56 and the base panel 52. A lid or closure member indicated generally at 62 may then be secured to the rear panel 56, as described in detail hereinafter, to provide a completely enclosed refrigerated compartment.

In accordance with an important aspect of the disclosed arrangement the right-hand side or end panel 60 is relatively thin and is of relatively light weight and yet contains all of the electrical, mechanical, and control components of the freezer 50 so that no hook-up or connections of any kind are required in assembling the freezer 50. More particularly, the right-hand side or end panel 60 contains within an inner wall 64 and an outer wall 66 (FIG. 4) thereof a complete mechanical refrigeration unit which includes an evaporator indicated generally at 68, a condenser indicated generally at 70 and a motor driven compressor indicated generally at 72 (FIG. 6) all of which are interconnected in a sealed refrigerant system. The right-hand side panel 60 also contains motor driven fans 74 and 76 for the evaporator 68 and condenser 70, respectively. The evaporator fan 74 is arranged to pull air from the interior of the freezer inwardly through the upper openings or louvers 78 in the inner wall 64, over the evaporator 68 so that the air is cooled and exhausts the cooled air into the interior of the freezer 50 through the lower openings 80 in the side wall 64 of the panel 60. The condenser fan 64 draws outside air inwardly through the openings 82 in the outer wall 66 and directs this air upwardly over the condenser 70 to cool the condenser 70, the heated air being exhausted through the upper openings 84 in the outer wall 66.

In order to seal the lid 62 to the upper edges of the panels 54–60 when the lid 62 is closed, a continuous gasket 98 (FIG. 21) is placed in grooves 98*a* formed in the upper edges of the panels 54, 56 and 58 and the groove 202 in the upper edge of the panel 60. The gasket 98 is engaged by a gasket 300 (FIG. 21) provided in the lid 62 so that the freezer compartment is tightly sealed when the lid 62 is closed.

In order to provide an access light which illuminates the interior of the freezer 50 when the lid 62 is open, the inner wall 64 of the panel 60 includes a translucent panel portion 86 behind which is positioned a light source 88. The light source 88 is controlled by a plunger type switch 90 (FIG. 3) which is mounted in the top wall of the panel 60 and is arranged to be controlled by a downwardly extending ridge 92 (FIG. 1) formed in the undersurface of the lid 62. When the lid 62 is opened, the ridge 92 releases the plunger switch 90 so that the light 88 is energized to provide illumination for the interior of the freezer 50. A power cord 93 extends outwardly from the outside wall and supplies electrical power to a fan motor 94 (FIG. 4), which drives the fans 74, 76 and the motor for the rotary compressor 72.

From this brief general description of the freezer 50 it will be seen that assembly of this freezer may be accomplished by relatively unskilled personnel and requires only the mounting of the side panels 54–60 on the base panel 52, mounting of the lid 62 on the rear wall 56 and plugging in the power cord 93 to provide an operative chest freezer.

2. Interlocking Surfaces And Seals Of Freezer 50

Before considering in detail the interlocking surfaces and seals provided in the disclosed arrangement to facilitate assembly of the modular panels of the freezer 50 to provide a tightly sealed freezer compartment, it should first be pointed out that in accordance with an important aspect of the disclosed arrangement the base 52, side panels 54–58 and lid 62 are all preferably formed by a twin sheet thermoforming process, described in more detail hereinafter, which permits the inclusion of intricate die formed ridges, troughs, grooves and shoulders in these panels so that accurately positioned interlocking surfaces and shoulders may be provided in the edges of these panels to permit ready assembly thereof without the use of special tools or fastening means. Considered very generally this twin sheet thermoforming process provides a panel, such as the front panel 54 having inner and outer walls 100 and 102 of sheet plastic which are die formed to the desired configuration and sealed together at the edges to form a hollow panel the interior of which is filled with an insulating material 104.

Considering first the manner in which the side panels 54–60 are assembled on the base panel 52, the base panel 52 is provided with elongated slots in the edges thereof, such as the elongated slots 106, 108 beneath the front panel 54 and the slots 110 and 112 beneath the left hand panel 58, these slots extending inwardly and downwardly at an angle to the vertical, as best illustrated in FIG. 8. The base panel 52 is also provided with an inwardly offset vertically extending wall portion 114 in which are formed outwardly extending projections 116 which are positioned outside the slots 106, 108 on the base panel 52, the bottom edges of the projections 116 forming interference shoulders which interlock with corresponding shoulders on the side panels to hold these panels tightly in place. More particularly, the side panels, such as the left-hand side panel 58 are formed with inwardly and downwardly extending tongue or locating tab portions 118 (FIG. 8) which are adapted to be inserted into the elongated slots 110, 112 in the base panel 52 to provide an accurately located interlocking arrangement between the side panels and the base panel. The side panels are also provided with recesses 120 in the inner vertical wall portion 122 thereof (FIG. 8), the recesses 120 defining interference shoulders 124 which are adapted to be engaged by and interlock with the projections 116 on the base panel 52. In this connection, it should be understood that the side panels, such as the side panel 58, are inserted into the base panel 52 by movement parallel to the elongated slots 110, 112, i.e., by movement along the direction of the arrow 126 shown in FIG. 8. Thus, the shoulders 124 are snapped into place behind the bottom edges of the projections 116 on the base panel 52 so that the side panel 58 is securely mounted on the base panel 52 without the use of special tools or separate retaining means. Preferably, the shoulders 124 and projections 116 have an interference overlap of approximately 0.050 inches, as illustrated in FIG. 8, to hold the side panels securely on the base panel 52. In this connection, it should be pointed out that the interference shoulders 116, 124 are shown for illustrative purposes only in solid lines in FIG. 8. These shoulders are actually positioned between the elongated slots 110 and 112 in the base member 52.

In order to interlock the adjacent edges of the side panels 54–60, the end panels, such as the end panel 58, are provided with a series of grooves 130 (FIG. 3) of any desired number in the vertical edge walls thereof which are adapted to receive corresponding tongues 132 formed in the corresponding edges of the front and rear panels 54 and 56. The grooves 130 and tongues 132 extend downwardly at an angle which is parallel to the elongated slots 110, 112 in the base panel 52. Accordingly, when the grooves 130 are fitted over the tongues 132 the locating tabs 118 are oriented at the right angle to be inserted into the elongated slots 110, 112 of the base panel 52. Thus, movement of the end panel 58 along the line 126 in FIG. 8 causes engagement of the tongue and groove interlocking means 130, 132 and at the same time the locating tabs 118 are inserted into the slots 110, 112 and the interference shoulders 124 are locked beneath the projections 116.

In order to tightly interlock the adjacent edges of adjacent side panels, an interference locking shoulder arrangement is also provided in these edges. More particularly, a series of vertically extending shoulders 134 are provided in the vertical edges of the end panel 58 intermediate the grooves 130 (FIGS. 3 and 10), the shoulders 134 being adapted to engage with cooperating vertically extending shoulders 136 (FIGS. 3 and 10) provided in the corresponding edge of the rear panel 56, and the front panel 54. Accordingly, as the grooves 130 are inserted over the tongues 132 in the rear panel 56, the shoulders 134 snap behind the shoulders 136 on the rear panel 56 and hold the side panel 58 securely connected to the adjacent edges of the front and rear panels throughout the length thereof.

In order to limit the inward movement of the side panel 58, as it is inserted on the base panel 52 and engaged with the front and rear panels 54 and 56, the front and rear panels 54 and 56 are provided with vertically extending limit shoulders 138 which cooperate with corresponding shoulders 140 (FIGS. 9 and 10) on the end panel 58 to limit inward movement of the end panel 58 as it is being mounted on the base panel 52 by movement in the direction of the arrow 126 in FIGS. 8 and 10.

In accordance with a further important aspect of the disclosed arrangement a dual sealing system is provided between the base panel 52 and the side panels and between adjacent edges of adjacent side panels to prevent a loss of cooling within the refrigerated compartment and to block solid and liquid debris from the panel interfaces. Referring first to the dual sealing arrangement provided between the base panel 52 and the side panels, such as the end panel 58, and referring particularly to FIG. 8, a first top opening trough 142 is provided in the outer edge of the base member 52 and a similar top opening trough 144 is provided in the outer edge of the inwardly offset portion 114 of the base member 52. The trough 142 is filled with gasket material 146 and the trough 144 is filled with gasket material 148. The gasket material 146 and 148 may be foamed in place at the time the base panel 52 is formed and filled with insulating material. Thus, the gasket material 146, 148 may comprise either foamed urethane or foamed silicone. In the alternative, the troughs 142, 144 may be filled with a solid gasket material which may comprise either solid silicone, solid vinyl or a solid rubber gasket.

In order to increase the effectiveness of the sealing gaskets 146 and 148, corresponding bottom edges of the side panels, such as the side panel 58, are provided with downwardly extending ridges 150 and 152 which engage with and compress the gasket material 146 and 148, respectively, as the side panel 58 is moved into place on the base panel 52.

In order to provide a similar dual sealing system between the adjacent vertical edges of the side panels, such as the adjacent edges of the side panel 58 and the rear panel 56, a vertically extending trough 154 is provided in the rear panel 56 inside of the limit shoulder 138, the trough 154 being filled with gasket material 156. Also, vertically extending troughs 158 are provided between the tongues 132 in the rear panel 56 and just inside of the locking shoulder 136 on this panel, the troughs 158 being filled with gasket material 160, as best illustrated in FIG. 10. As the side panel 58 is moved into place, the outwardly projecting shoulders 134 on the vertical edges thereof snap behind the corresponding vertically extending locking shoulders 136 of the rear panel 56, the shoulders 134 engaging and compressing the gasket material 160 within the troughs 158, as illustrated in FIG. 10. The vertical edges of the side panel 58 are also provided with vertically extending ridges 162 (FIG. 10) which are positioned inside the limit shoulders 140 on the vertical edges of the panel 58 and engage and compress the gasket material 156 in the troughs 154 when the side panel 58 is moved into place against the limit shoulders 138, 140. The gaskets 154 and 158 may either be foamed in place or comprise solid gasket material, as discussed in detail heretofore in connection with the gaskets 146, 148 on the base panel 52.

3. Lid Locking Arrangement

Figure 11:
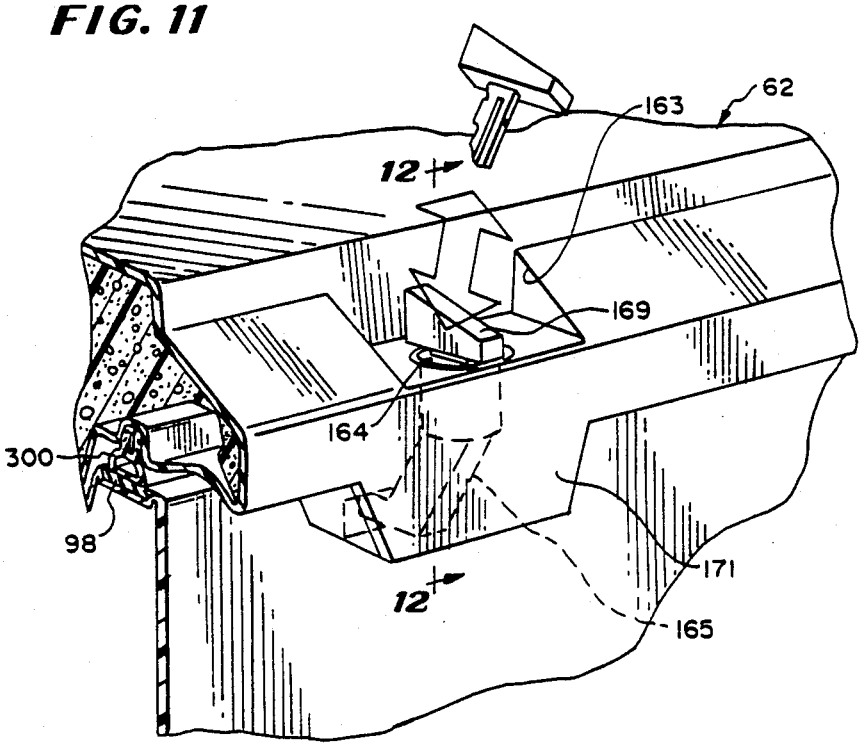
FIG. 11 is a fragmentary perspective view, on an enlarged scale, of the lid locking arrangement employed in the freezer of FIG. 1.
Figure 12:
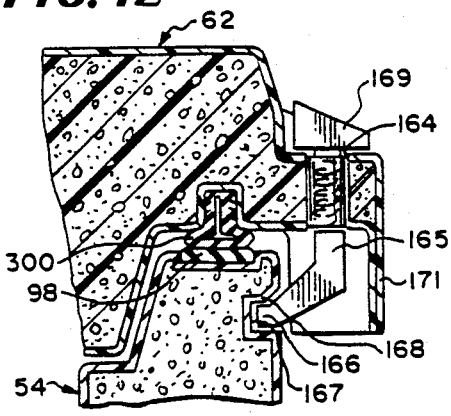
FIG. 12 is a sectional view taken along the line 12—12 of FIG. 11.
Figure 15:
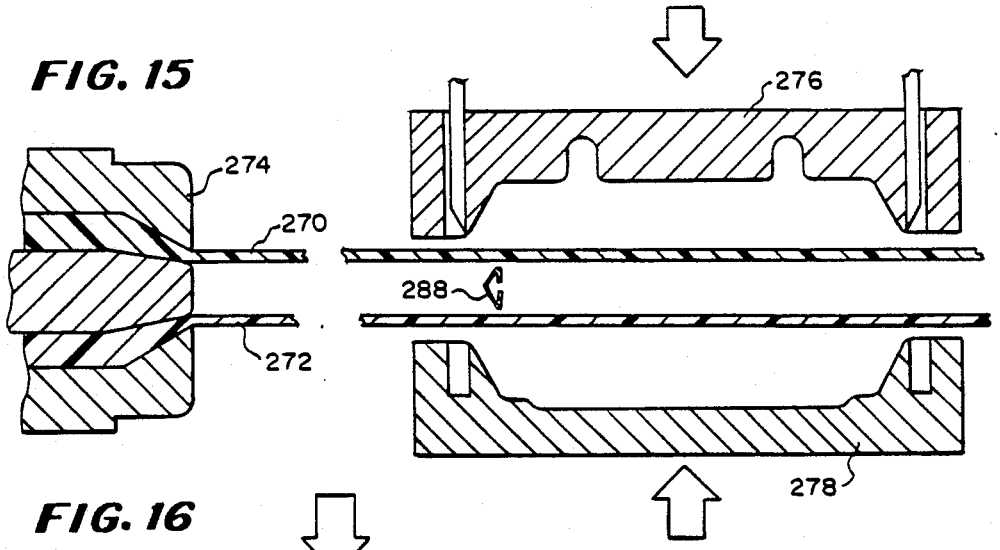
FIGS. 15–19 are diagrammatic illustrations of different steps in the twin sheet thermoforming process employed to manufacture the panels of the freezer of FIG. 1.

In accordance with a further important aspect of the disclosed arrangement, the lid 62 is provided with a locking arrangement whereby the lid 62 may be locked in place after it has been closed without requiring the provision of any holes in the front panel 54 which would reduce the insulation provided thereby. Furthermore, this lid locking arrangement is provided in the lid 62 and the front panel 54 as these panels are shipped to the final destination so that no assembly of parts is required in assembling the freezer 50. Thus, referring to FIGS. 11 and 12, the forward edge of the lid 62 is provided with a recess 163 within which is mounted a vertically extending cylinder type lock 164. A downwardly projecting arm 165 is connected to the rotatable portion of the lock 164, the arm 165 having an offset end portion 166 which moves into a groove 167 formed in the front wall of the front panel 54 when the lock 164 is rotated while the lid 62 is closed. Accordingly, when the arm 165 is moved to the position shown in FIG. 12, the offset end portion 166 thereof is positioned beneath the shoulder 168 formed by the top wall of the groove 157 in the front panel 54 so that the lid 62 is locked in place and cannot be opened. The lock 164 is arranged to receive a key 169. When the key 169 is rotated, the arm 165 is moved out of the groove 167 thus permitting the lid 62 to be opened. It will be noted that the disclosed arrangement does not require any holes through the front panel 54 or in the lid 62 inside of the sealing gasket 300 thereof, so that the insulation of these members is not compromised. Preferably the outer edge of the lid 62 is provided with a downwardly extending bracket portion 171 which covers the rotary arm 165 to prevent injury to the user's fingers when the lid 62 is closed and locked.

4. Side Wall Panel Containing Mechanical Refrigeration Unit

As discussed generally heretofore, the modular side panel 60 contains all of the electrical components for the sealed mechanical refrigeration system and controls therefor, and yet is relatively thin and of relatively light weight and is particularly suitable for use in the illustrated knockdown or demountable chest freezer wherein the side panels and base panels may be readily assembled to provide a complete refrigeration unit by relatively unskilled personnel. However, it should be pointed out that the modular side panel unit 60 which can be prebuilt, quality checked and then enclosed, may equally well be employed in other types of refrigeration apparatus either of the knockdown or demountable type, or refrigeration apparatus manufactured as a complete unit as original equipment.

Considering now in more detail the modular side panel unit 60, and referring to FIGS. 4 to 7, inclusive, a molded plastic divider wall indicated generally at 170 is positioned between the inner wall 64 and outer wall 66 of the panel 60 and extends generally vertically therebetween. A layer of foam insulation 172 is provided on the inner wall of the divider wall 170 and the evaporator 68 is mounted on the divider wall 170 inside of the insulation layer 172. The condenser 70 is mounted on the outside surface of the divider wall 170 and somewhat below the evaporator 68. A fan shroud 174, which is mounted on the outer surface of the divider panel 170 and surrounds the driving motor 94 and the condenser fan 76 which is of squirrel-cage configuration, is provided with an opening 176 which is in alignment with the lower openings 82 in the outer wall 66 of the panel 60 so that exterior air is sucked into the fan 76 and is directed by means of the shroud 174 upwardly through the coils of the condenser 70. The arrangement also provides some cooling for the compressor 72 which is mounted below the condenser coils 70 (FIG. 6) as the exterior air is forced over the condenser coil 70 and out of the upper openings 84 in the outer wall 66. A fan shroud 178 is also provided for the evaporator fan 74, the shroud 178 being mounted on the inner surface of the divider wall 170 and having a cover 179. The cover 179 has an opening 180 therein so that air which is pulled in through the upper openings 78 of the inner wall 64 and over the evaporator 68, through the opening 180 and into the fan 174, is directed laterally and forced out of the offset lower openings 80 (FIG. 3) in the inner side wall 64 of the panel 60.

Figure 4:
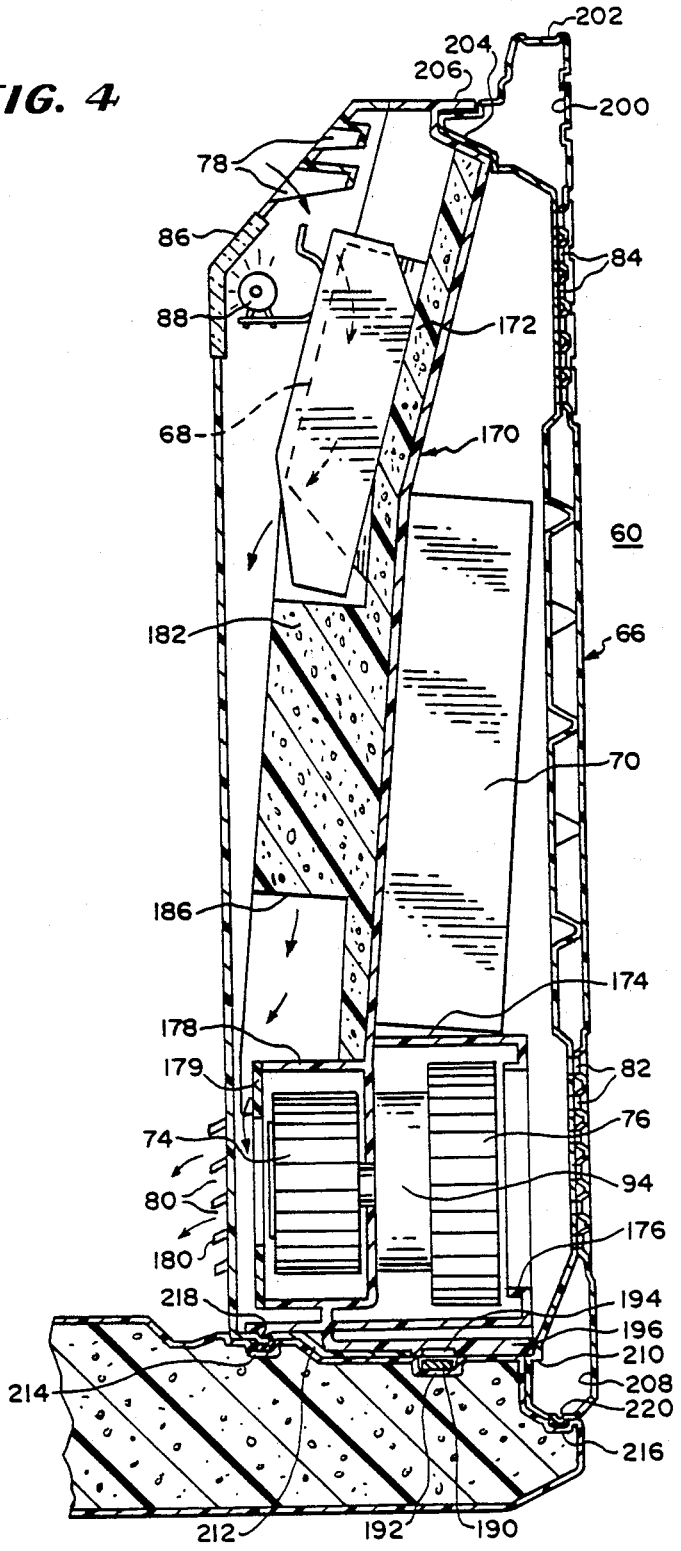
FIG. 4 is a sectional view taken along the line 4—4 of FIG. 3.
Figure 5:
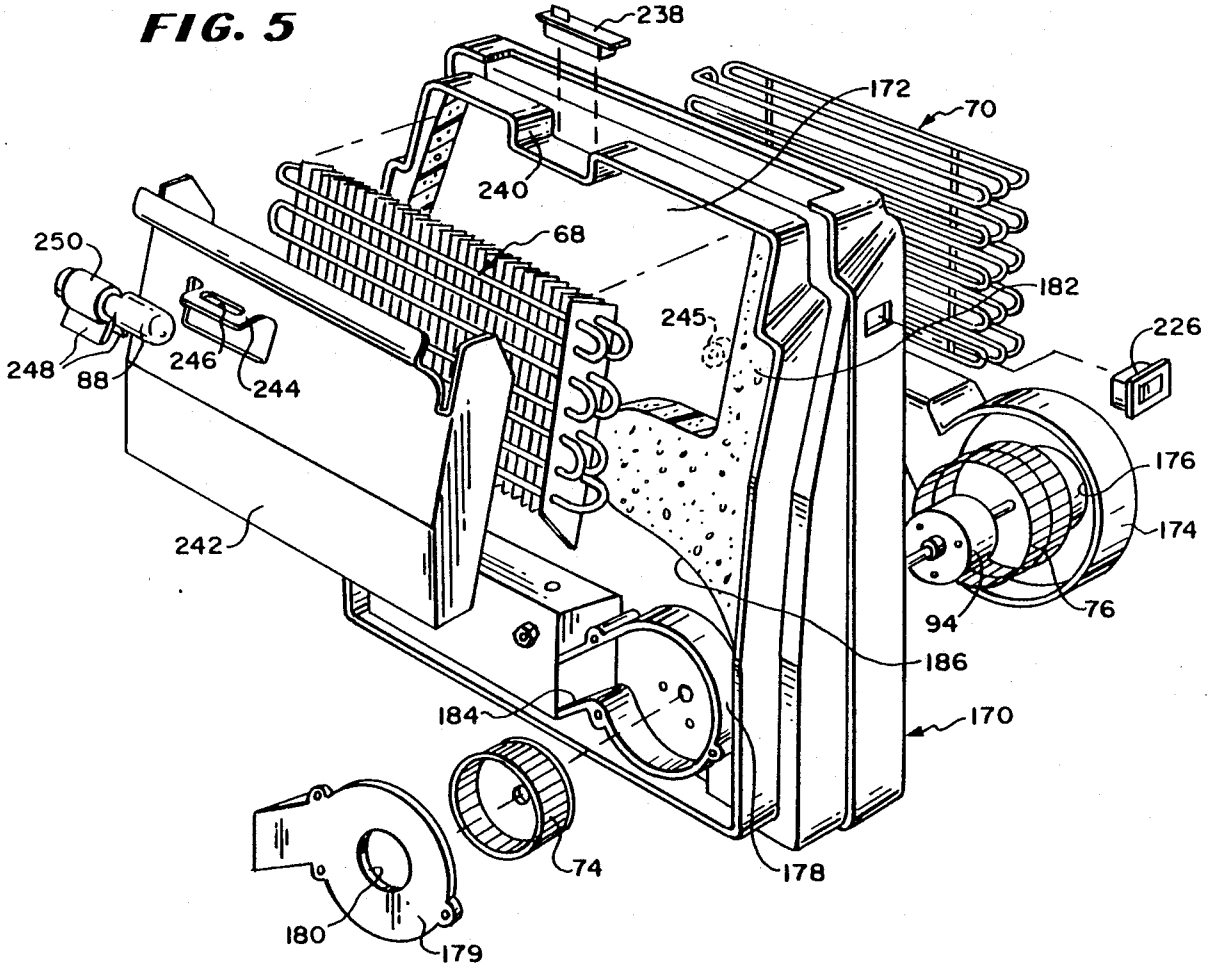
FIG. 5 is an exploded perspective view of the sealed refrigeration unit contained within one of the side walls of the freezer of FIG. 1.
Figures 6, 7:
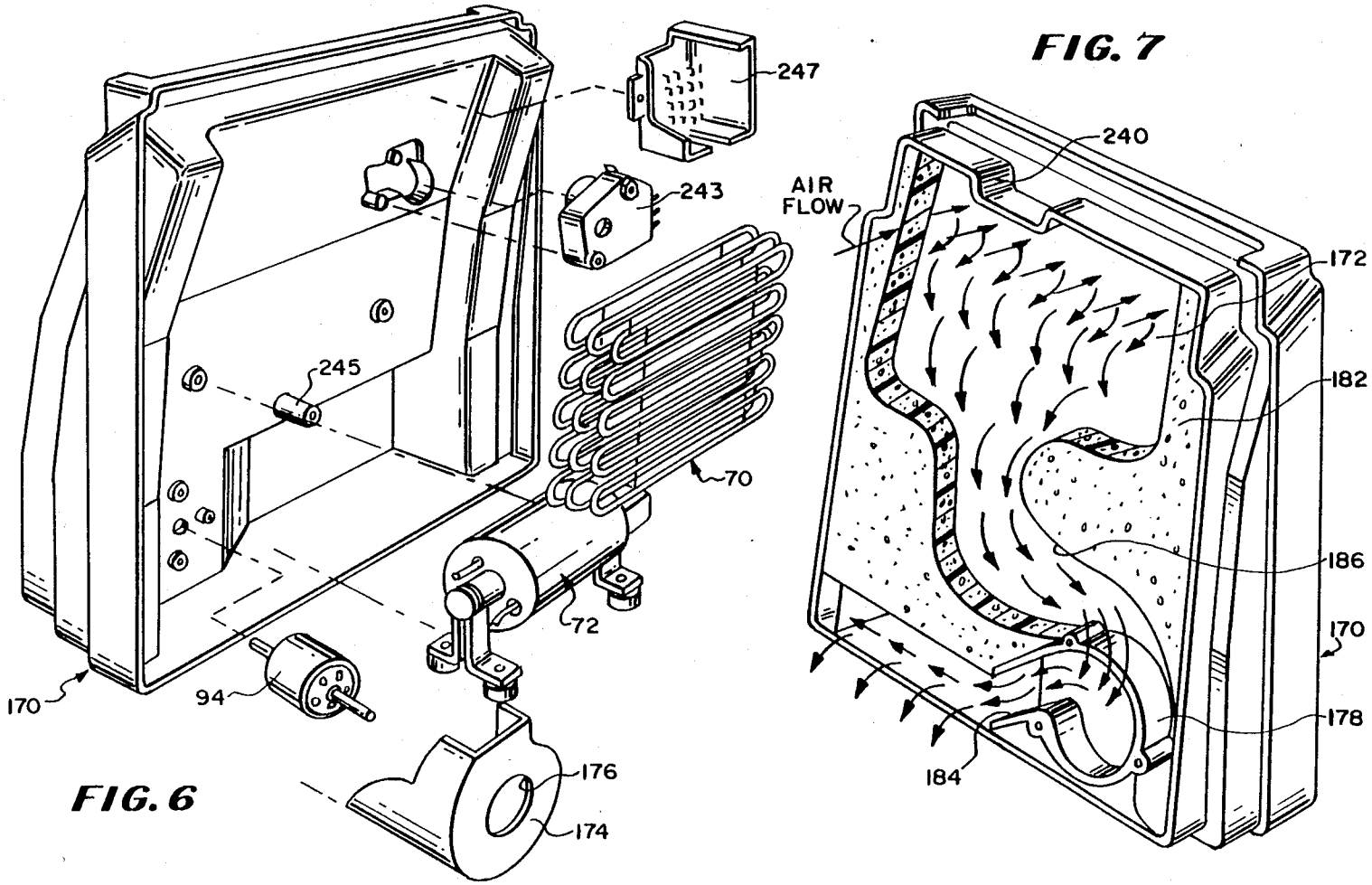
FIG. 6 is an exploded perspective view of the sealed unit of FIG. 5 showing the other side of the unit.
FIG. 7 is a fragmentary perspective view of the unit of FIG. 5 and illustrating the air flow path in the evaporator section of the unit.

In accordance with an important feature of the disclosed arrangement a second layer of foam insulation 182, which may be integral with the insulating layer 172, is shaped to surround the evaporator 68 and forms an air duct 186 (FIG. 7) which directs air, which has been pulled through the evaporator coils 68, into the opening 180 of the evaporator fan shroud 178. The fan 74 then directs this air through the outlet 184 of the shroud 178 and through the lower openings 80 in the inner wall 64 into the interior of the freezer 50. The foam layer 182 which forms the air duct 186 may be preformed and, thereafter, securely affixed, for example, by a suitable adhesive, to the divider wall 170 or may be molded in place or may be formed by the twin sheet thermoforming process discussed hereinafter as insulation formed in and assuming the configuration of an insulation cavity formed between and defined by the spaced apart interior surfaces of two spaced apart and interconnected plastic sheets, that is, the divider wall 170 and another plastic planar wall (not illustrated) at the outer planar surface of the foam layer 182 (as depicted in FIGS. 4, 5 and 7) and joined to the wall 170 during the twin sheet thermoforming process.

In accordance with a further important feature of the disclosed arrangement, means are provided for sensing when the side panel 60 has been assembled on the base panel 52, this sensing means being employed to prevent the mechanical refrigeration unit in the panel 60 from being turned on until it is properly mounted in a vertical position on the base panel 52. More particularly, a permanent magnet 190 (FIG. 4) is mounted in a recess 192 in the base panel 52 in the area which will be covered by the side panel 60 when it is assembled on the base 52, as best illustrated in FIGS. 2 and 4. A conventional reed switch 194 is mounted in the transverse bottom wall portion 196 of the divider wall 170 (FIG. 4) and is positioned so that when the panel 60 is mounted on the base 52 the reed switch 194 will be actuated by the permanent magnet 190. Reed switch 194 is connected in series with the main on/off power switch 198 (FIG. 3), which is mounted in the top wall of the panel 60, so that power cannot be applied to the panel 60 until it has been mounted on the base panel 52.

The outer wall 66 of the panel 60 is preferably formed by the twin sheet thermoforming process to provide the upper openings 84 in the wall 60 and the lower openings 82. The wall 66 also includes an upper hollow portion 200 which is uninsulated and is provided with a trough 202 in the top wall thereof which is adapted to receive the sealing gasket 98. Portion 200 is also provided with an inwardly extending wall 204 which is generally V-shaped and is adapted to receive the transverse upper end 206 of the divider wall 170, which is of a similar configuration, so that the upper ends of the outer wall 66 and the divider wall 170 may be joined by any suitable plastic sealing process. The bottom end of the outer wall 66 is also provided with a hollow portion 208 that provides rigidity for the bottom edge of the outer wall 66 and includes a shoulder 210 which is adapted to receive the transverse bottom wall portion 196 of the divider wall 170, as best illustrated in FIG. 4. The upper end of the inner wall 64 is secured to the top portion 206 of the divider wall 170 by any suitable heat sealing arrangement and the bottom wall portion 212 of the inner wall 64 extends beneath the transverse wall portion 196 of the divider 170 and is sealed thereto by any suitable heat sealing process so that side panel 60 is a completely sealed modular unit.

Figure 9:
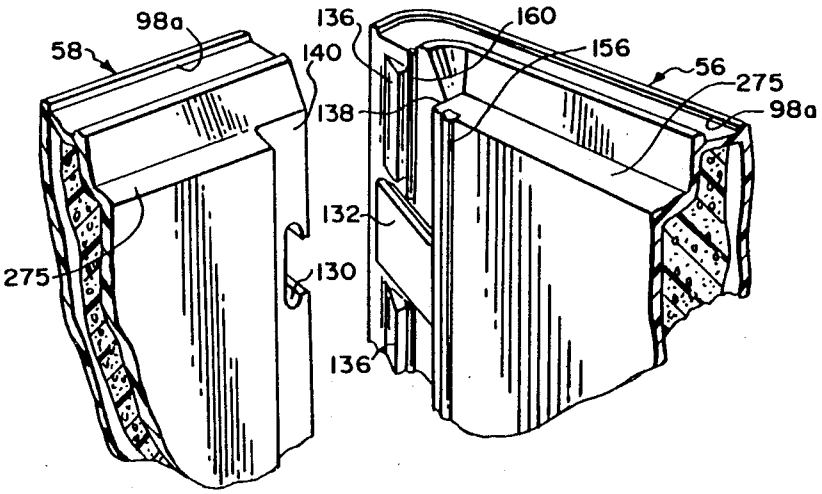
FIG. 9 is a fragmentary perspective view of the interlocking and sealing arrangement employed in the side panels of the freezer of FIG. 1.

In order to provide a dual sealing arrangement for the bottom edge of the side panel 60 which is similar to the dual sealing gaskets described in detail heretofore in connection with the other side panels of the freezer 50, the base panel 52 is provided with the troughs 214 and 216 which are filled with either foam or solid gasket material, the trough 214 being positioned beneath the wall portion 212 of the inner wall 64 and the trough 216 being positioned beneath the bottom end of the outer wall 66. Downwardly extending ridges 218 and 220 are provided in the wall portion 212 and in the bottom edge of the outer wall 66 which are adapted to engage and compress the gasket material within the troughs 214 and 216, respectively, when the side panel 60 is mounted on the base panel 52. The vertical side wall portions of the inner wall 64 are provided with downwardly extending slots 222 and 224 (FIG. 3) which are adapted to engage corresponding tongues 223, 225 (FIG. 2) in the inner walls of the front and rear panels 54 and 56 so as to interlock these side wall portions with the front and rear panels in the manner described in detail heretofore in connection with installation of the side panel 58. The side panel 60 which contains the mechanical refrigeration unit described heretofore, can readily be assembled onto the base panel 52 after the front and rear walls 54 and 56 have been assembled thereto by engagement of the grooves 222 and 224 with their corresponding tongues 223, 225 on these front and rear walls. At the same time the ridges 218 and 220 engage the gaskets within the troughs 214 and 216 so that a seal is provided between the unit 60 and the base panel 52. The base panel 52 is also provided with grooves 227 (FIG. 2) in the area beneath the bottom edge of the panel 60 which are adapted to receive corresponding tongues (not shown) on the bottom edge of the panel 60 as the panel 60 is moved inwardly and downwardly onto the base 52. In order to seal the vertical edges of the panel 60 to the front and rear walls 54, 56 these edges are provided with gaskets which engage vertically extending limit shoulders 229 (FIG. 2) as the panel 60 is moved inwardly against these shoulders. The limit shoulders 229 correspond to the limit shoulders 138 (FIGS. 3 and 9)

on the front and rear panels 54, 56 which limit inward movement of the side panel 58.

Figure 13:
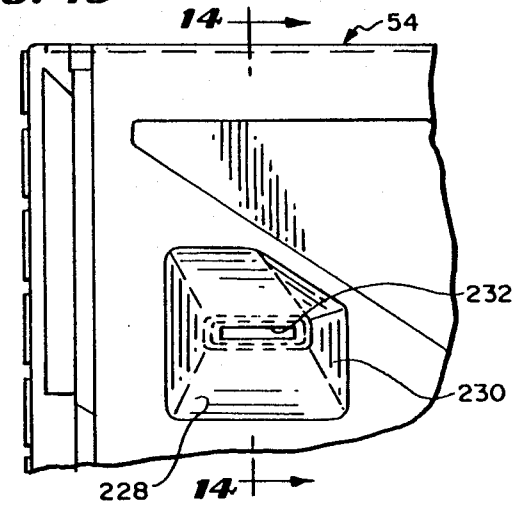
FIG. 13 is a fragmentary rear view of the front panel of the freezer of FIG. 1 showing the upper left hand corner of the rear side of said front panel.
Figure 14:
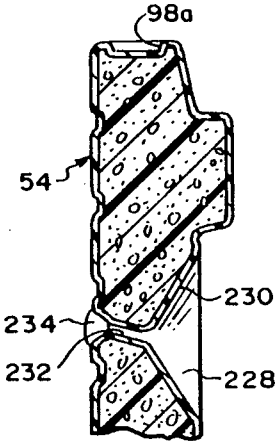
FIG. 14 is a sectional view taken along the line 14—14 of FIG. 13.

In accordance with a further important feature of the disclosed arrangement, a light source 226 (FIGS. 3 and 5) in the front wall of the divider panel 170 is positioned so that when the unit 60 is interconnected with the base 52 and front panel 54 the light source 226 directs light outwardly through an opening 228 in the front wall 54, as best illustrated in FIGS. 13 and 14. The opening 228 is provided with sloping side walls 230 to direct light through a smaller opening 232 in the remainder of the front panel 54 to a lens 234 which is mounted in the outer end of the light tube 232. Source 226 is arranged to be energized when the main power switch 198 is turned on so that a visual indication is provided to an outside observer during periods when the power is applied to the freezer 50. Preferably the lens 234 may be amber colored to provide a suitable indicating light that the mechanical refrigeration unit is turned on.

The controls for the side panel 60, which include the plunger type switch 90 for the access light 88 and the power on/off switch 198 are mounted on the upper wall portion 206 of the divider wall 170 and all of the electrical connections to these components are included within the panel unit 60. In addition, a multiposition slide type power level switch 236 (FIG. 3) is also mounted on the upper wall 206 of the divider wall 170 and cooperates with the thermostat 238 mounted in a recess 240 formed in the upper wall 206 to control the level of refrigeration within the freezer 50, in a manner readily apparent to those skilled in the art. An aluminum heat shield 242 (FIG. 5) is mounted on the divider wall 170 and surrounds the evaporator coils 68. The heat shield 242 is provided with an outwardly extending tab portion 244 having a slot 246 therein which is adapted to receive clip portions 248 of the light socket 250 for the lamp 88. If desired, a suitable calrod heating unit (not shown) may be positioned within the shield 242 and controlled by a timer 243 (FIG. 6) mounted on the divider wall 170 to provide an automatic defrost cycle in a conventional manner. An outlet tube 245, which is mounted on the divider wall 170, acts as a drain for water accumulated during the defrost cycle. The tube 245 may extend through a suitable opening (not shown) in the outer wall 66 of the panel 60. A terminal block 247 is also mounted on the divider wall 170 and is employed to establish the required electrical connections within the panel 60.

In accordance with a further important aspect of the disclosed arrangement, a plunger type switch 252 (FIG. 3) is mounted on the forward edge of the upper wall 206 of the side panel 60 and is employed to detect when the lid 62 of the freezer 50 has been left ajar. More particularly, the switch 252 is provided with a set of normally closed contacts 254 (FIG. 3A). The plunger type switch 90 at the back of the panel 60, which controls the access light 88, is also provided with a second set of normally opened contacts 256 which are connected in series with the contacts 254 to a power source 258. The relay coil of a time delay relay 260 is connected in series with the contacts 254 back to the other side of the power source 258. The relay contacts of the time delay relay 260 are arranged to energize an alarm 262 in the event that both of the sets of contacts 254 and 256 are closed and the time delay established by the relay 260 has expired. When the lid 62 is open, the contacts 254 and 256 have the position shown in FIG. 3A. When the lid 62 is closed the contacts 256 are always closed because of the proximity of the switch 90 to the hinge edge of the lid 62. However, since the switch 252 is mounted near the front edge of the lid 62 the contacts 254 of the switch 252 may not be opened unless the lid is closed sufficiently to actuate the switch 252. Accordingly, if the lid 62 is left slightly ajar by an amount such that the plunger of the switch 252 is not depressed a sufficient amount to open the contacts 254 of the switch 252, the relay 260 is energized and, after the predetermined delay established by the relay 260 has expired, the alarm 262 (FIG. 3A) is energized. The alarm 262 may either be an audible alarm or a flashing of the light source 226 which is visible through the front panel 54 of the freezer 50 (FIG. 3B) as described in detail heretofore. The arrangement of FIG. 3A thus provides an audible or visual indication to the user that lid 62 of the freezer 50 has not been tightly closed, i.e., by an amount sufficient to open the contacts 254 of the switch 252.

If desired, an alternative arrangement may be provided for detecting when the lid 62 has been left ajar. Referring to FIG. 3B, a differential pressure switch 264 may be provided with the normally closed contacts 266 which are opened when a predetermined pressure differential is established between the inside of the freezer 50 and the exterior thereof. When the lid 62 of the freezer 50 is open, warm air enters the freezing compartment; and, after the lid is closed again, it takes several seconds to reestablish a vacuum, i.e., to provide a lower pressure within the freezing compartment of the freezer 50. During periods when the lid 62 is opened, the contacts 266 of the pressure differential switch 264 are closed because the pressure within the freezer 50 is the same as exterior air pressure. However, if the lid 62 is tightly closed, the pressure is soon reduced within the freezing compartment of the freezer 50 and the contacts 266 open. If this occurs before the end of the time delay established by the time delay relay 260, the alarm 262 is not energized. However, if the lid 62 has been left ajar, the contacts 266 will not be opened and an alarm will be given at the end of the delay established by the relay 260. In other respects the circuit arrangement of FIG. 3B is identical to that described heretofore in connection with FIG. 3A. The pressure differential switch 264 may, for example, be mounted on the divider wall 170 at a point where one side of the switch is exposed to exterior or ambient air, the other side of this switch 264 communicating with the interior of the freezer 50 through a suitable sensing tube.

5. Forming Freezer Panels By Twin Sheet Thermoforming Process

As discussed generally heretofore, the base panel 52 and the side panels 54, 56 and 58, and the lid 62 are all preferably formed by employing a twin sheet thermoforming process. Such a process is believed to be old, per se, in fields other than the domestic or household appliance field. However, applicants believe they are the first to use such a process in domestic or home appliances, particularly where thermal conductivity through the panel is important, as in the illustrated chest freezer 50.

Referring now to FIGS. 15–19 wherein the individual steps of the twin sheet thermoforming process of the disclosed arrangement are illustrated diagramatically, first and second sheets of plastic material 270 and 272 are extruded from the extrusion head 274 and are immediately positioned between two opposed open die members 276 and 278 of a die thermoforming fixture, the die members 276, 278 having formed on the internal surfaces thereof the desired configuration of the inner and outer walls of the final panels. The die members 276 and 278 are then closed to the position shown in FIG. 16 and air is admitted into the space 280 between the opposed sheet portions 270*a* and 272*a* so that these plastic sheets are forced outwardly into the internal surfaces of the die members 276 and 278 to form the desired shape of the final panel. In the alternative, the plastic sheets 270*a* and 272*a* may be sucked outwardly against the internal surfaces of the die members 276 and 278 by applying a suitable vacuum through holes in the die members.

Figure 16:
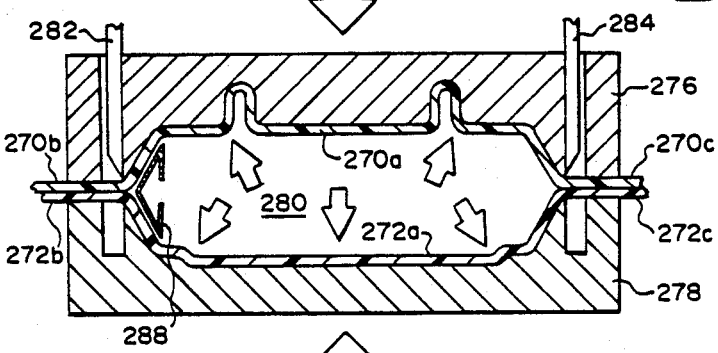
Figure 17:
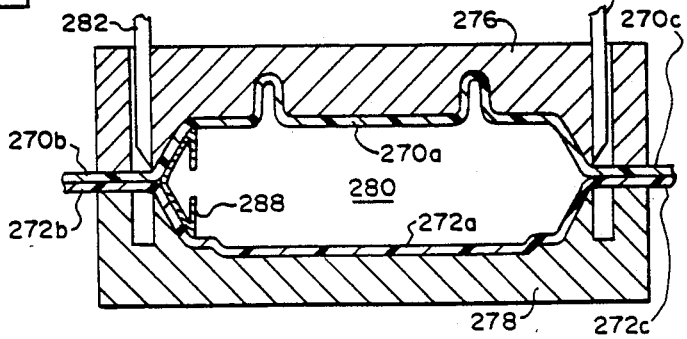
Figure 18:
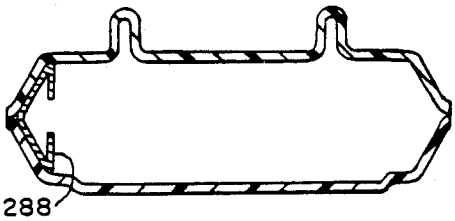

When the die members 276 and 278 are closed, the edges 270*b* and 270*c* of the sheet 270*a* are sealed with the edges 272*b* and 272*c* of the sheet portion 272*a* to form a completely sealed hollow panel, as shown in FIG. 16. The knives 282 and 284, which are mounted in the upper die member 276, are then moved downwardly to trim the edge portions 270*b*, 270*c* and 272*b*, 272*c* from the hollow panel so as to provide the finished panel indicated in FIG. 18. The sheets 270 and 272 may be of any suitable plastic material, for example, a polyvinylchloride, an acrylonitrile butadiene styrene (ABS) polymer or a high impact polystyrene.

Figure 19:
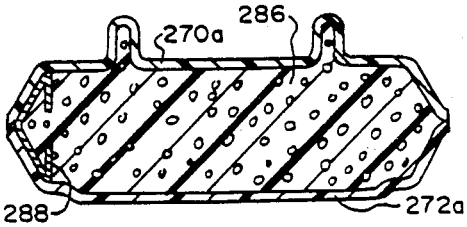

When the thermal conductivity through the panel side walls is important, the space 280 between these side walls may be filled with an insulating material 286 (FIG. 19). In such case, the die thermoforming fixture 276, 278 is moved to a foam machine where foam insulation is introduced preferably while the side walls 270*a* and 272*a* are positioned within the die members 276 and 278, this foam insulation being introduced through a suitable opening in one of the die members. The insulation may be foamed in place while the side panels 270*a* and 272*a* are supported by the internal surfaces of the die members 276 and 278 so that the side panels are prevented from being deformed while the foam insulation is being introduced. In the alternative, the insulating material 286 may comprise a rigid insulation panel which is introduced between the sheets 270 and 272 before the die members 276 and 278 are closed. This rigid insulation panel may comprise polystyrene bead board which under pressure and temperature expands to fill the space 280 between the side walls 270*a* and 272*a*.

In accordance with a further important aspect of the twin sheet thermoforming process of the disclosed arrangement, one or more inserts, which may be of metal or other rigid material, may be provided between the inner and outer sheets 270*a* and 272*a* to provide rigidity or stiffness in desired areas of the panel or to provide a suitable metal insert which can be used for mounting components, such as hinges, to the final panel. For example, the triangularly-shaped metal insert 288 (FIG. 15) may be positioned between the twin plastic sheets 270 and 272 while they are spaced apart between the open die members 276 and 278 when the die thermoforming fixture is closed to the position shown in FIG. 16. The insert 288 is then positioned adjacent one end wall of the space 280 between the panel sheets 270*a* and 272*a*.

Utilization of the above-described twin sheet thermoforming process in forming either hollow or insulated panels suitable for use in the domestic or home appliance field has many advantages, particularly when such process is used to manufacture the base lid and side panels of the illustrated chest freezer 50. Thus, the base panel 52 and the side panels 54, 56 and 58 may be manufactured in one operation while providing all of the above-described complex interlocking surfaces, gasket ridges and troughs, and, if desired, foamed gasket insulation as well. By utilizing the described process, light weight, rigid panels having the desired thermal insulation and yet including the complex interlocking surfaces required for assembling these panels together in the manner described in detail heretofore, may be provided by means of the die members 276 and 278. Furthermore, this single manufacturing operation can also provide the basket supporting ledges 275 and 277 on the front and rear panels 54 and 56, the top grooves 98*a* and 202 for the gasket 98, the ornamental trim corrugations 279 on the upper portions of the outer walls of the panels 54–60, and the ridges 281 on the base panel 52 which provide air passages between the food and the floor of the freezer compartment and promote a more uniform temperature within the freezer 50. Accordingly, the total number of parts is greatly reduced and secondary operations such as welding, painting and sealing may be eliminated.

The plastic sheets 270 and 272 may also be of different plastic materials in situations where plastic material having one set of characteristics is desired for the outer wall of the panel, and a plastic material having different characteristics is desired for use as the inner wall of the panel. For example, a rigid, high impact plastic material may be used for the outer wall of the panel, whereas a smoother or softer plastic material, which is easy to clean, may be used for the inner wall of the panel. In addition, the plastic sheets 270 and 272 may comprise plastic materials of different colors where a particular color is required for the outside of the freezer and a different color for the interior of the freezer. Also, these sheets of plastic of different colors may have different physical characteristics, as described above, if desired. Furthermore, the entire exterior of the freezer 50 is non-corrosive since it is formed by the outer walls of the twin sheet thermoformed panels which are of plastic material.

The described twin sheet thermoforming process particularly lends itself to the provision of foam insulation between the side walls of the panel which may be foamed in place, preferably while the plastic sheets are backed up by the die members 276 and 278, as described heretofore. In addition, the provision of metal inserts which are incorporated while the panel is being formed is particularly desirable for mounting components on the finished panel during the manufacturing process and before the panel is shipped to its final destination for assembly.

Figure 21:
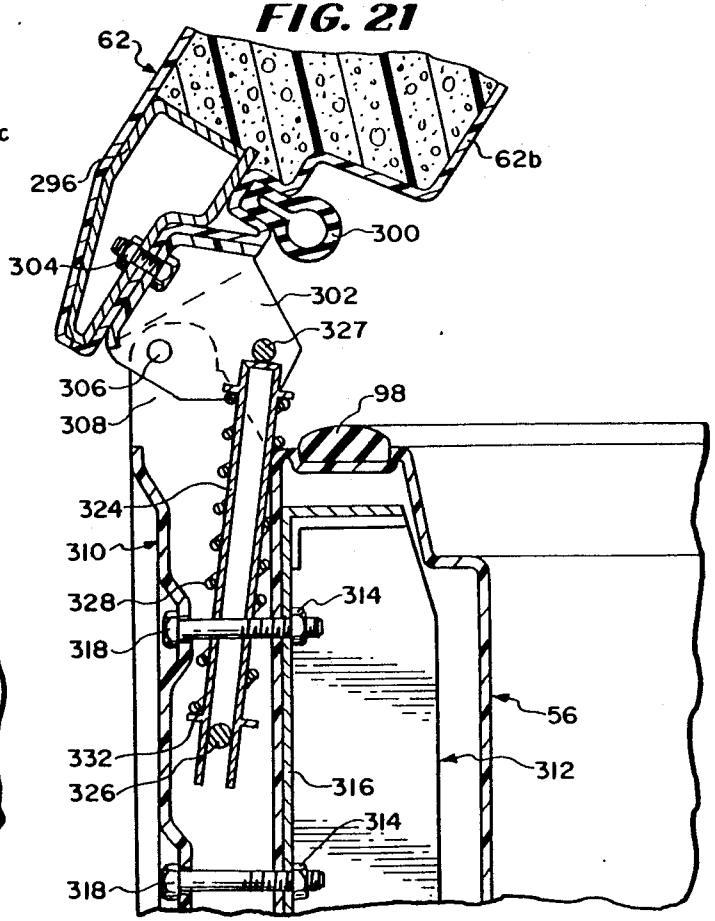
FIG. 21 is a sectional view similar to FIG. 20 but shows the lid in a raised position.
Figure 20:
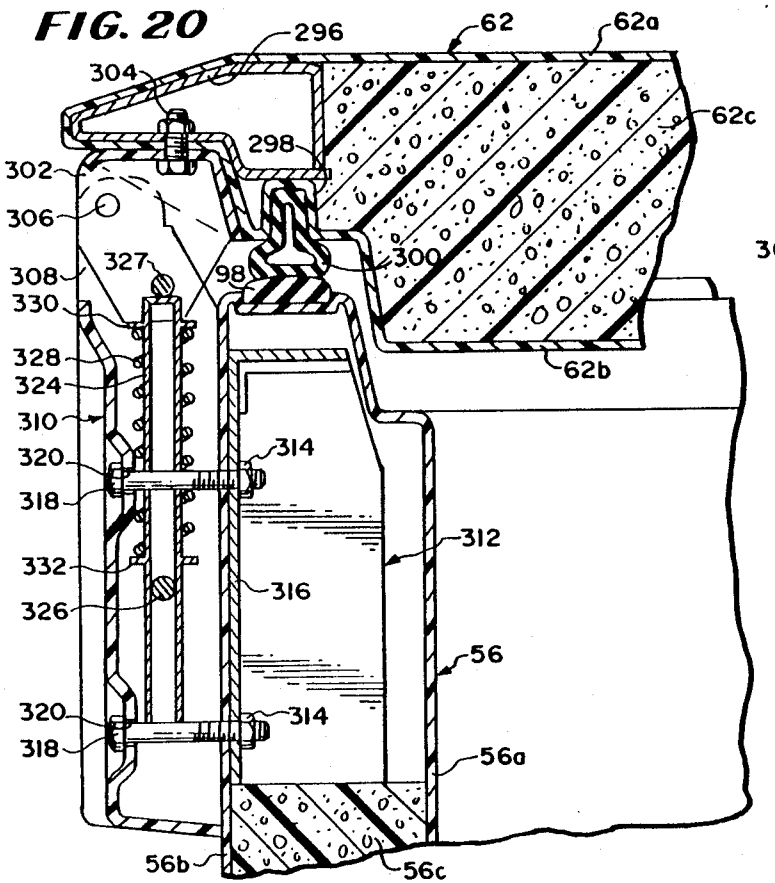
FIG. 20 is a sectional view taken on an enlarged scale along the line 20—20 of FIG. 2 and showing the lid hinge arrangement of the freezer of FIG. 1.

One example of the use of such inserts, is shown in connection with the provision of hinges for the lid 62, as shown in detail in FIGS. 20 and 21. Referring to these figures, the metal insert 296 is provided along the rear edge of the lid 62, the insert 296 being positioned between the side walls 62*a* and 62*b* of the panel 62 while this panel is being formed and the insulation 62*c* foamed in place therebetween so that the insert 296 is rigidly held in place within the lid 62. Bottom wall 62*b* of the lid 62 is also provided with the trough 298 (FIG. 20) around the periphery thereof which is adapted to receive the upper sealing gasket 300 which cooperates with the gasket 98 provided in the top grooves of the side walls of the freezer 50 to provide a tight seal around the perimeter of the lid 62. A pair of upper hinge brackets 302 are mounted on the rear edge of the panel 62 by means of the bolts 304. A hinge pin 306 is positioned between the side walls of the upper hinge bracket 302 and extends outwardly therefrom to pivotally mount the upper flange portions 308 of a pair of lower hinge brackets indicated generally at 310.

In order to provide a simple mounting arrangement for securing the lower hinge brackets 310 to the upper edge of the rear panel 56 of the freezer 50, a metal insert indicated generally at 312 is positioned between the side walls 56*a* and 56*b* of the rear panel 56 while the panel 56 is being formed and before the insulation 56*c* has been added. Accordingly, the insert 312 is rigidly held in place along the upper edge of the panel 56 and may have the nuts 314 secured to the inner surface of the back wall 316 of the insert 312. All that is then required to mount the lid 62 on the rear panel 56 is to insert the bolts 318 through the openings 320 in the outer wall 322 of the lower bracket 310 and to thread these bolts into the nuts 314 on the metal insert 312. Preferably, the openings 320 in the outer bracket wall 322 are elongated to provide slots so that the lid 62 may be leveled on the upper edge of the rear panel 56 as it is assembled thereto.

In order to provide an arrangement for biasing the lid 62 upwardly to facilitate opening thereof and to hold it in an upper open position, a pair of U-shaped members 324 are slidably mounted over a rod 326 which extends between the side walls of the lower hinge bracket 310, the upper ends of the U-shaped members 324 engaging a pin 327 which extends between the side walls of the upper bracket 302 when the upper and lower brackets 302 and 310 are assembled together. A coil spring 328 is positioned around each of the U-shaped members 324 and extends between outwardly extending flanges 330 and 332 provided along the length of the U-shaped member 324. When the lid 62 has the closed position shown in FIG. 20, the springs 328 are compressed. Since the pin 327 is offset relative to the hinge pin 306, the spring 328 facilitates lifting of the lid 62 to the upper position shown in FIG. 21. When the lid 62 is in the position shown in FIG. 21, the springs 328 are fully extended and provide sufficient force to hold the lid 62 in the open position. It should be noted that all of the hinge parts may be assembled to the lid 62 before the lid is shipped to the point of assembly. Accordingly, all that is required in assembling the lid 62 onto the rear wall 58 is inserting the bolts 318 into the nuts 314 while the lid 62 is resting on the gasket 98.

Obviously, many modifications and variations of the present invention are possible in light of the above teachings. Accordingly, it is to be understood that, within the scope of the appended claims, the invention may be practiced otherwise than as specifically described hereinabove.

What is claimed and desired to be secured by Letters Patent is:

1. A refrigeration appliance comprising a plurality of side panels and a base panel each panel comprising a pair of spaced apart walls of plastic material which are sealed at the edges thereof to form a hollow panel, at least some of said side panels and said base panel each having a layer of insulation positioned between said spaced apart walls of the hollow panel, one of said side panels having a complete mechanical refrigeration unit positioned within the hollow panel formed by said spaced apart plastic walls thereof, each of said side panels and said base panel having cooperating means formed in the plastic walls of said hollow panel for interconnecting said side panels with said base panel and with each other, whereby said side panels may be readily assembled on said base panels without the use of tools by simple engagement of said interconnecting means to provide a refrigerated compartment.

2. A refrigeration appliance as set forth in claim 1 further including a closure panel having hinge means secured to one edge thereof, and means for securing said hinges to the upper edge of another one of said side panels, thereby to provide a completely enclosed refrigerated compartment.

3. A refrigeration appliance as set forth in claim 2 wherein said hinges include brackets adapted to be secured to said other side wall.

4. A refrigeration appliance as set forth in claim 3 wherein said brackets include slots adapted to receive bolts which extend into said other side wall to clamp said brackets thereto, said slots permitting adjustment of the level of said closure panel to provide a tight seal for said refrigerated compartment.

5. A refrigeration appliance as set forth in claim 2 wherein said closure panel includes a gasket which cooperates with a gasket mounted in the upper edges of said side panels to provide a tight seal for said refrigerated compartment.

6. A refrigeration appliance as set forth in claim 1 wherein said one side panel contains within said spaced apart plastic walls thereof a sealed mechanical refrigeration system including an evaporator, a condenser, and a compressor interconnected in a sealed refrigerant system.

7. A refrigeration appliance as set forth in claim 6 wherein said one side panel contains within said spaced apart plastic walls thereof motor driven fans for moving air over said evaporator and condenser so that air cooled by said evaporator is supplied to the interior of said refrigerated compartment and air heated by said condenser is forced out of said one side panel to the exterior.

8. A refrigeration appliance as set forth in claim 7 wherein said one side panel contains within said spaced apart plastic walls thereof a motor for driving said compressor.

9. A refrigeration appliance as set forth in claim 2 wherein said one side panel includes an access light and switch means controlled by said closure panel for energizing said access light during periods when said closure panel is open.

10. A refrigeration appliance as set forth in claim 14 wherein said access light is positioned behind a translucent panel which forms a portion of the inner wall of said one side panel.

11. A refrigeration appliance as set forth in claim 2 wherein said one side panel contains means for measuring the temperature within said enclosed refrigerated compartment and control means controlled by said temperature measuring means for controlling said complete refrigeration unit.

12. A refrigeration appliance as recited in claim 11 wherein said temperature measuring means includes a thermostat.

13. A refrigeration appliance as recited in claim 11 wherein said control means includes a control unit mounted on the top wall of said one side panel.

14. A refrigeration appliance comprising a plurality of side panels and a base panel, one of said side panels containing within the inner and outer walls thereof a complete mechanical refrigeration unit, each of said side panels and said base panel having cooperating means for interconnecting the same, whereby said side panels may be readily assembled on said base panel by simple engagement of said interconnecting means to provide a refrigerated compartment, a closure panel having hinge means secured to one edge thereof, means for securing said hinges to the upper edge of another one of said side panels, thereby to provide a completely enclosed refrigerated compartment, an arm rotatably mounted in one edge of said closure panel, said arm being positioned to move beneath a shoulder formed in the upper edge of one of said side walls when said arm is rotated while said closure panel rests on said one side panel, thereby to provide a latching mechanism for holding said closure panel in a closed position.

15. A refrigeration appliance as set forth in claim 14 wherein said latching mechanism includes a key-operated lock, whereby said refrigerated compartment may be locked by removing the key from said lock while said arm is positioned beneath said shoulder.

* * * * *